US007152535B2

(12) United States Patent
Mikich et al.

(10) Patent No.: US 7,152,535 B2
(45) Date of Patent: Dec. 26, 2006

(54) SUSPENDED STORAGE SHELF

(75) Inventors: Michael J. Mikich, Las Vegas, NV (US); Dwayne Dunseath, Las Vegas, NV (US); Timothy M. Matthias, Las Vegas, NV (US); Mark C. Torosian, Las Vegas, NV (US)

(73) Assignee: Hyloft, Inc., Las Vegas, NV (US)

( * ) Notice: Subject to any disclaimer, the term of this patent is extended or adjusted under 35 U.S.C. 154(b) by 0 days.

(21) Appl. No.: 10/768,225

(22) Filed: Jan. 30, 2004

(65) Prior Publication Data

US 2004/0182291 A1 Sep. 23, 2004

Related U.S. Application Data

(63) Continuation-in-part of application No. 09/966,929, filed on Sep. 28, 2001, now Pat. No. 6,715,427, which is a continuation-in-part of application No. 09/690, 654, filed on Oct. 17, 2000, now Pat. No. 6,435,105.

(51) Int. Cl.
*A47B 23/00* (2006.01)

(52) U.S. Cl. ..... 108/42; 108/149; 211/113

(58) Field of Classification Search ..... 108/42, 108/149, 186; 211/113, 181.1, 118, 117, 211/119; 298/317, 340
See application file for complete search history.

(56) References Cited

U.S. PATENT DOCUMENTS 3,139,045 A * 6/1964 Rojakovick ..... 108/109
3,735,951 A * 5/1973 Reed ..... 248/340
4,441,583 A * 4/1984 Vaught ..... 182/150
5,379,564 A * 1/1995 Wynne ..... 52/458
6,145,678 A * 11/2000 Morrison ..... 211/113
6,286,691 B1 * 9/2001 Oberhaus et al. ..... 211/118
6,311,626 B1 * 11/2001 Roberts ..... 108/42
6,409,031 B1 * 6/2002 Wynne ..... 211/119
6,435,105 B1 * 8/2002 Mikich et al. ..... 108/42
6,715,427 B1 * 4/2004 Mikich et al. ..... 108/42

FOREIGN PATENT DOCUMENTS

EP 206994 A1 * 12/1986

* cited by examiner

*Primary Examiner*—Jose V. Chen
(74) *Attorney, Agent, or Firm*—Robert Ryan Morishita; Morishita Law Firm, LLC

(57) ABSTRACT

A suspended storage shelf includes a platform formed by one or more panels supported by a support frame having at least one support beam and at least two suspension posts, optionally adjustable in length, spaced from one another and attached at a lower end to the support beam. A fastener secures the support frame to a structure. In an embodiment with two or more panels, the panels form a continuous surface by, for example, being positioned adjacent one another along the support beam, being secured to one another such as with a coupling, and/or being secured to the support beam. Optionally, the panels are positioned along the support beam and the length of the support beam is such that the suspension posts retain the panels in adjacency. Optionally, the suspension posts are attached at the ends of the support beam each of which extend beyond the platform.

37 Claims, 10 Drawing Sheets

SUSPENDED STORAGE SHELF

RELATED APPLICATION DATA

The present application is a Continuation-in-Part of U.S. patent application Ser. No. 09/966,929 entitled "Suspended Storage Structure" filed Sep. 28, 2001, now U.S. Pat. No. 6,713,427 which, in turn, was a Continuation-in-Part of U.S. patent application Ser. No. 09/690,654 entitled "Suspended Storage Structure" filed Oct. 17, 2000, now U.S. Pat. No. 6,435,105.

FIELD OF THE INVENTION

The present invention relates to shelving. More specifically, the present invention is a storage shelf suspended beneath a structure.

BACKGROUND OF THE INVENTION

Suspended storage structures, including Applicant's own prior U.S. Pat. No. 6,435,105 and U.S. Des. Pat. Nos. 459,926 and 470,353, all incorporated herein by reference, are known in the art. Examples of suspended structures are also shown in references assigned to Applicant, such as U.S. Pat. No. 6,409,031 and U.S. Des. Pat. No. 416,152, also incorporated herein by reference. These devices, along with the present invention, are intended to address some of the drawbacks of other suspended storage structures.

For example, U.S. Pat. No. 4,441,583 to Vaught shows a cable hanger intended to support a swinging scaffold hanging from a walkway grating. Since the scaffold is intended to swing, a loop of cable carries the scaffold. However, it is often undesirable for a storage shelf to swing as the scaffold of Vaught does. Moreover, it is desirable to suspend a storage shelf from structures other than a walkway grating.

SUMMARY OF THE INVENTION

A storage shelf for suspending from a structure includes a platform formed by one or more individual panels. Optionally, the platform includes two or more individual panels. The platform is supported by a support frame having at least one support beam and at least two suspension posts spaced from one another and attached at a lower end to the support beam. The support beam and suspension posts may optionally be integrally formed. In one optional embodiment, the panels are of substantially equal length and the support beam is an integer multiple of the panel length. A fastener secures the support frame to the structure such that the support beam and suspension post cooperate to suspend the platform from the structure.

In one optional embodiment, the support beam has two ends, each of which extend beyond the platform. In such an optional embodiment, support frame may include a suspension post attached at a lower end to each support beam end.

In an optional embodiment, the suspension post or posts are of adjustable length. For example, in one optional embodiment the suspension post includes at least two post elements and the length of the suspension post is adjusted by selectively joining the post elements.

In an optional embodiment in which two or more panels are provided, the panels form a substantially continuous support surface by, for example, positioning the panels adjacent one another along the support beam, securing each panel to an adjacent panel, and/or securing each panel to the support beam. In an optional embodiment, the storage shelf includes a coupling securing adjacent panels. In one particular optional embodiment, the panels are formed from a grid of wire members and the coupling comprises a clamp securing adjacent wire members of adjacent panels. In another optional embodiment, the panels are positioned along the support beam and the length of the support beam is such that the suspension posts retain the panels in adjacency.

DESCRIPTION

Figure 1:
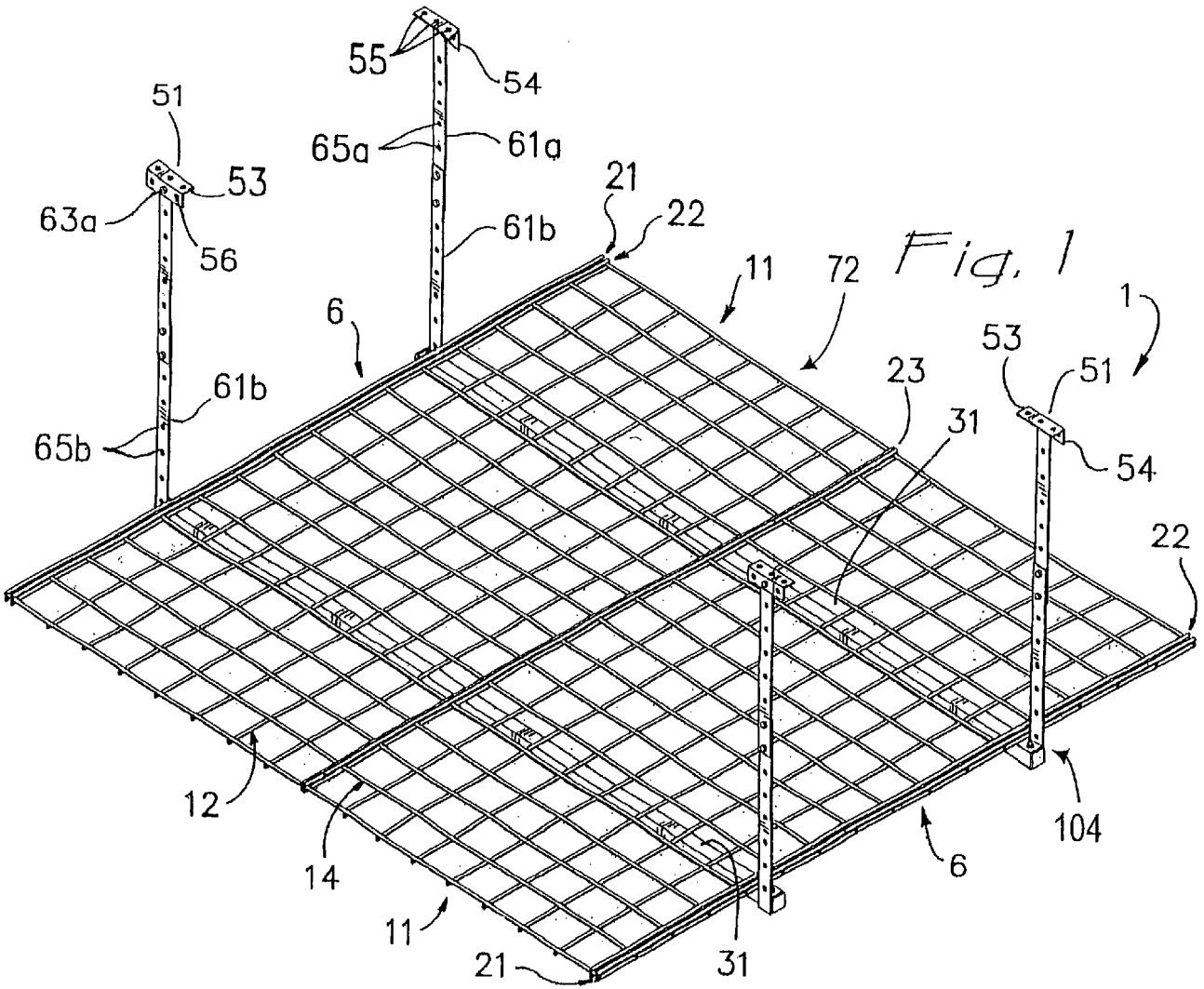
FIG. 1 shows an elevated perspective view of an embodiment of a suspended storage shelf according to the present invention.

Reference is now made to the figures wherein like parts are referred to by like numerals throughout. Referring generally to FIGS. 1–13, the present invention is a suspended storage shelf 1. The storage shelf 1 is suspended from an overhead structure 100 such as a ceiling or other overhead surface. The storage shelf generally includes a platform 72, a support frame 104 having at least one support beam 31 and at least two spaced suspension posts 61, and a fastener 51.

The storage shelf 1 includes a platform 72 formed by one or more individual panels 11. The panels 11 may take any shape, but in an optional embodiment, the panels 11 are planar. Also, while the panels 11 may have any construction, including solid construction, in an optional embodiment, the panels 11 are formed from a wire grid in which wire members 12, 14 cooperate to form the panels 11.

As stated, only one panel 11 is needed to form the platform 72. However, it is also contemplated that multiple panels 11 may be used to form the platform 72. In an optional embodiment including, two or more panels 11, the panels 11 form a substantially continuous surface. This may occur in many different ways. For example, in one optional embodiment, such as that shown in FIGS. 5, 6, and 13, each panel 11 is secured to an adjacent panel 11, such as through a coupling or a hinge. In an optional embodiment, the coupling is a clamp 101, such as that formed from a mating bolt 102 and nut 103, that secure and retain adjacent wire members 23 along the edges 9 of adjacent panels 11 in substantial contact.

Figure 2:
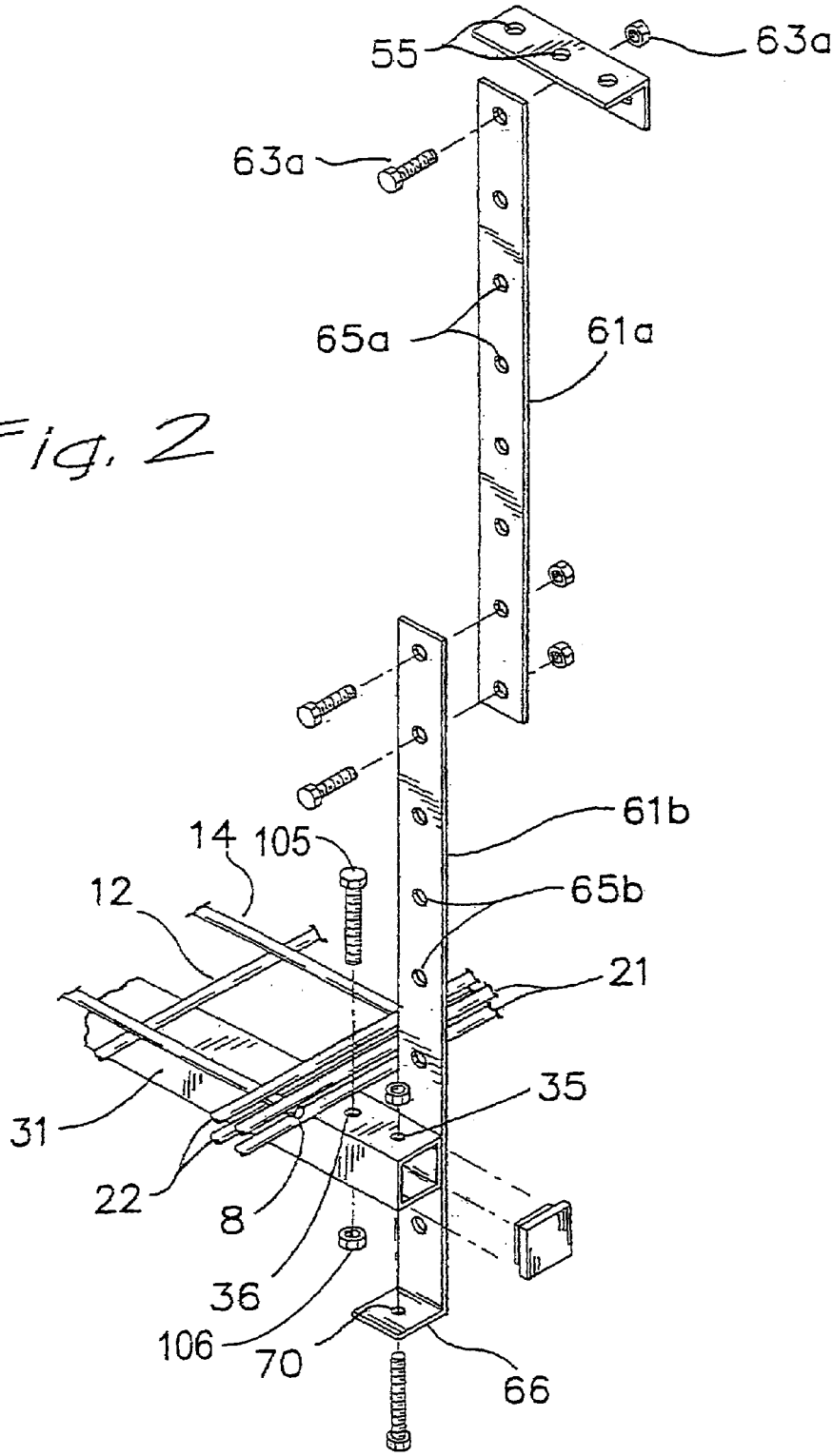
FIG. 2 shows a perspective assembly view of an embodiment of a suspended storage shelf according to the present invention.
Figure 4:
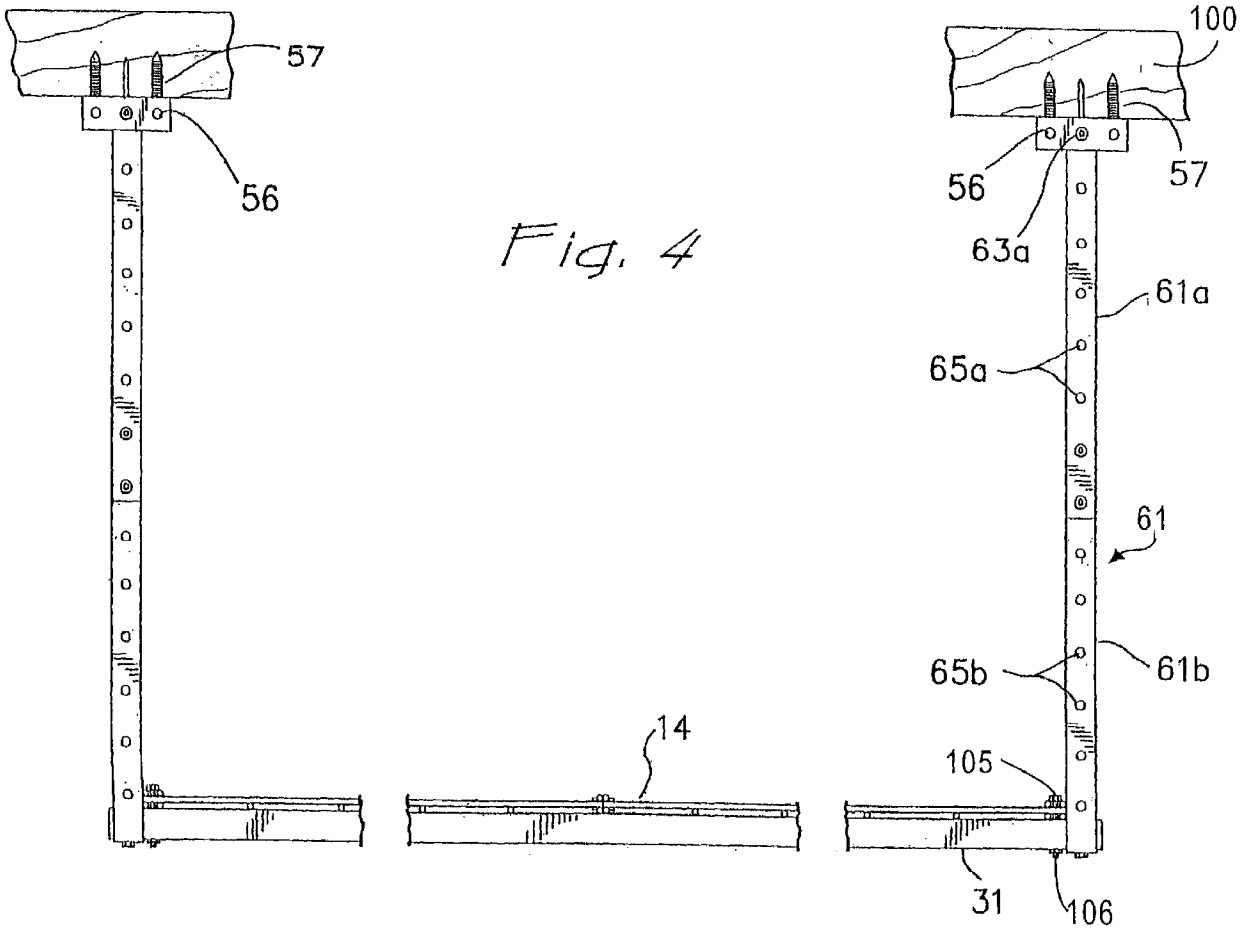
FIG. 4 shows an end view of an embodiment of a suspended storage shelf according to the present invention mounted to a structure.
Figure 5:
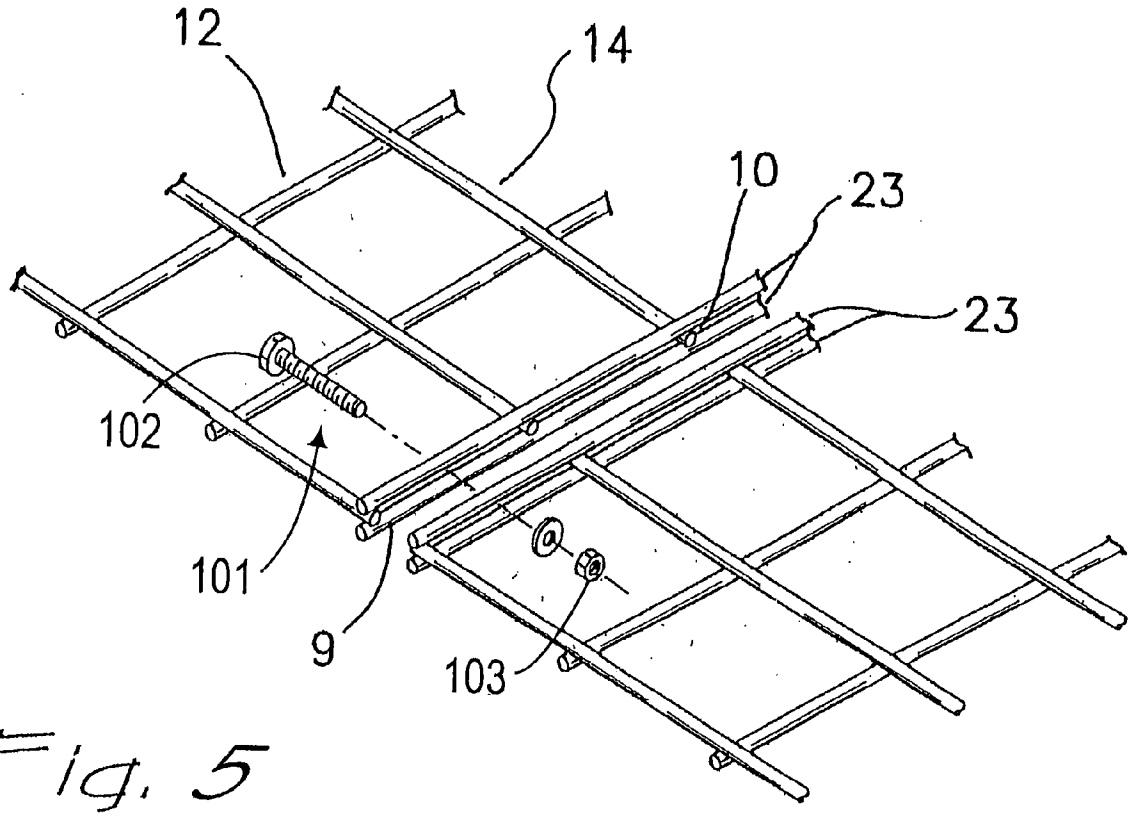
FIG. 5 shows a perspective assembly view of an embodiment of a coupling according to the present invention.

In another optional embodiment, such as that shown in FIGS. 2 and 4, the panels 11 are formed into a substantially continuous surface by securing each panel 11 to a support beam 31. For example, a mating bolt 105 and nut 106 threaded through a hole 36 in the support beam 31 and through a gap between wire elements 21, 22 may secure and retain panels 11 to the support beam 31 adjacent one another.

Figure 9:
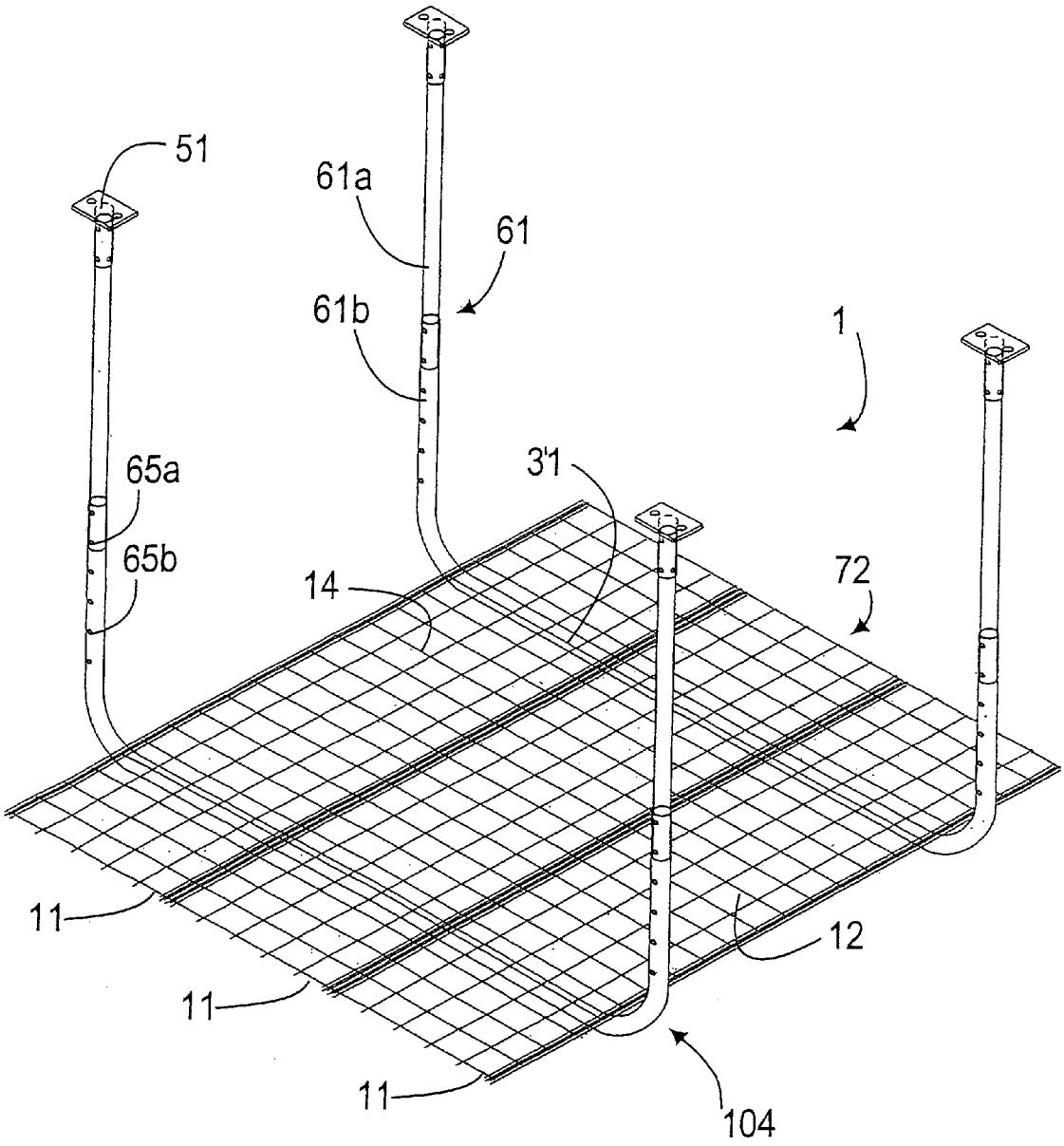
FIG. 9 shows an elevated perspective view of an alternate embodiment of a suspended storage shelf according to the present invention.
Figure 10:
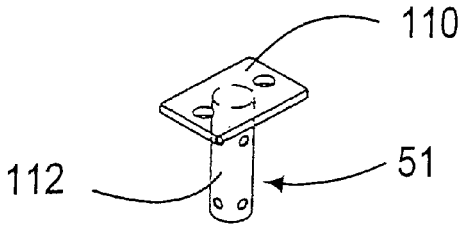
FIG. 10 shows an elevated perspective view of a fastener according to the optional embodiment of FIG. 9.
Figure 11:
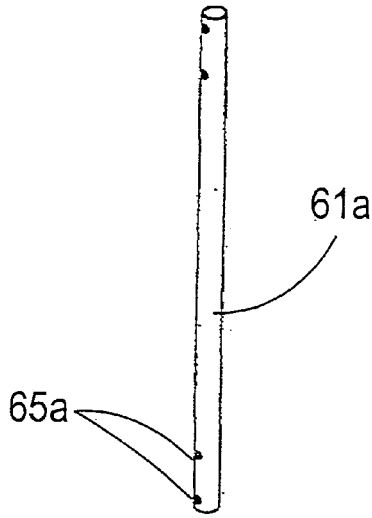
FIG. 11 shows an elevated perspective view of a suspension post element according to the optional embodiment of FIG. 9.
Figure 12:
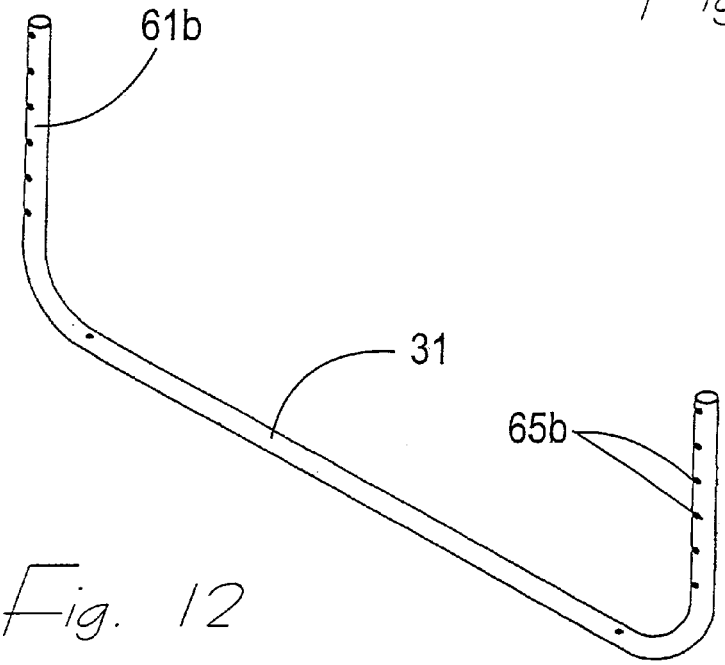
FIG. 12 shows an elevated perspective view of a suspension post element and support beam according to the optional embodiment of FIG. 9.

In one optional embodiment, such as that shown in FIGS. 1 and 9, the panels 11 are positioned along a support beam 31 in adjacent relationship so that the panels 11 cooperate to form a substantially continuous surface. In one optional embodiment, the panels 11 may be oriented with the edges 9 of adjacent panels 11 perpendicular to the support beam 31 such that the support beam 31 prevents the panels 11 from separating. In this embodiment, as well as the other embodiments described, the support beam 31 may be of a length that the suspension posts 61 retain the panels 11 in adjacency. In one particular optional embodiment, the panels 11 are of substantially equal length and the support beam 31 is an integer multiple of the panel length to accommodate an integer number of panels 11.

Figure 6:
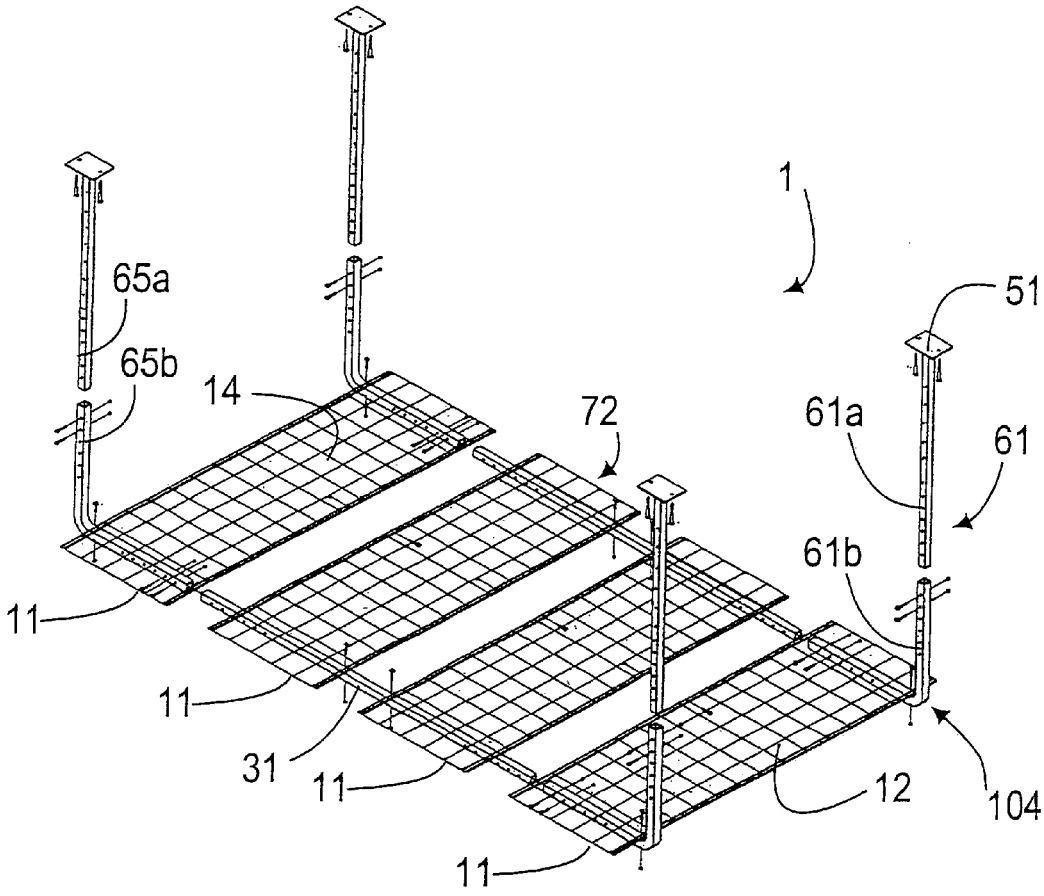
FIG. 6 shows a perspective assembly view of an alternate embodiment of a suspended storage shelf according to the present invention.
Figure 7:
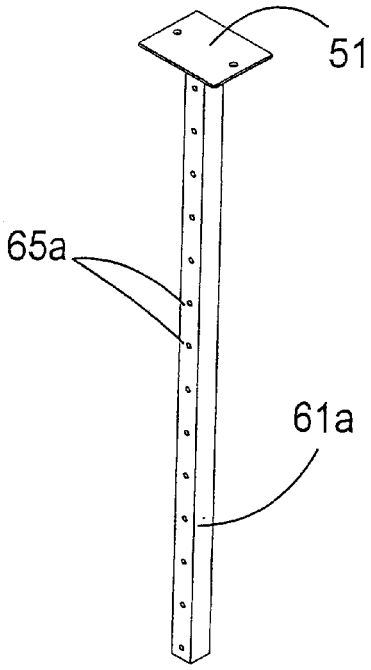
FIG. 7 shows an elevated perspective view of a fastener and suspension post element according to the optional embodiment of FIG. 6.
Figure 8:
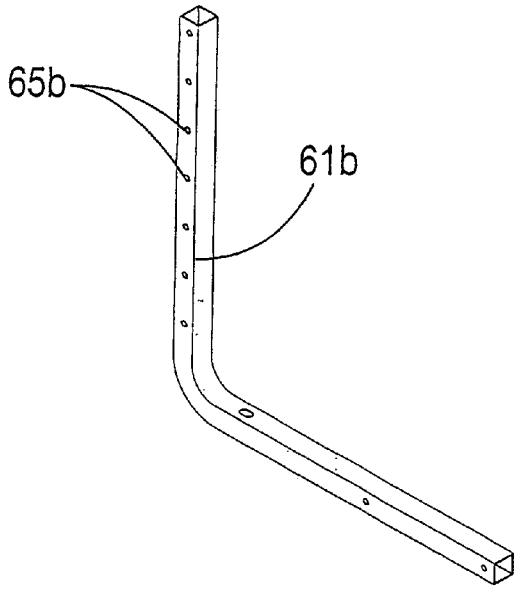
FIG. 8 shows a perspective view of a suspension post element according to the optional embodiment of FIG. 6.

Turning to the support frame 104, as discussed above, the support frame 104 includes at least one support beam 31 attached to at least two suspension posts 61 spaced from one another. It should be noted that although the terms "beam" and "post" usually connote narrow, elongate structures, it is contemplated that either the support beam 31 and/or the suspension posts 61 may be flat and/or planar to aid in supporting the platform 72. In the optional embodiment of FIGS. 1 and 2, for example, each of two support beams 31 are connected to a lower end of two suspension posts 61. While the optional embodiment of FIGS. 1 and 2 shows each support beam 31 attached to a suspension post 61 at its ends, it is contemplated that the suspension posts 61 could be attached to the support beam 31 at any point along the length of the support beam 31. Similarly, although the optional embodiment of FIGS. 1 and 2 show the ends of the support beam 31 extending beyond the edges 6 of the platform 72, it is contemplated that the support beam 31 may be of any length, either longer or shorter, with respect to the platform 72. In another embodiment, such as that shown in FIGS. 6–12, the support beam 31 and suspension posts 61 are connected through a corner joint that serves to form a suspension post element 61*b* as well as a portion, shown of FIG. 8, or all, shown in FIG. 12, of the support beam 31. It is noted that the support beam 31 need not necessarily be unitary and may optionally comprise joined sections as shown in FIGS. 6–8.

The support beams 31 and suspension posts 61 may be attached to one another in a non-permanent, or even releaseable fashion. For example, in the optional embodiment of FIG. 2, an L-shaped flange 66 at the lower end of the suspension posts 61 may include a hole 70 that aligns with a hole 35 in the support beam 31. A mating nut and bolt threaded through the aligned holes 35, 70 attach the flange 66, and consequently the suspension post 61, to the support beam 31. In an alternate optional embodiment, shown in FIG. 3, the support beams 31 and suspension posts 61 are integrally formed. For example, a support beam 31 and suspension posts 61 could be formed into a U-shape with the support beam 31 disposed between two suspension posts 61, such as the embodiment shown in FIGS. 6 and 9, or an O-shape substantially similar to the U-shaped form but with an extra support frame member connecting the ends of the suspension posts 61 opposite the support beam 31.

The suspension posts 61 are optionally adjustable in length. For example, in one optional embodiment, the suspension posts 61 each include post elements 61*a*, 61*b* that may be selectively joined to adjust the length of a suspension post 61. More specifically, an upper post element 61*a* includes holes 65*a* therethrough. A lower post element 61*b* includes holes 65*b* therethrough. When the holes are aligned, mating bolts and nuts may retain the relative positions of the upper post element 61*a* and the lower post element 61*b* with respect to one another. By shifting the holes 65*a*, 65*b* aligned by increasing or decreasing the overlap between the upper post element 61*a* and lower post element 61*b*, the overall length of the support post 61 may be adjusted. In alternate optional embodiments (not shown), the post elements may mate, that is, an outer post element may receive an inner post element such that the length may be adjusted by inserting or removing the inner post element from the outer post element; or the post elements may engage one another end-to-end such that addition or removal of post elements alter the length.

As noted above, the support frame 104 is attached to the structure 100 through a fastener 51 such that the suspension posts 61 and the support beam 31 cooperate to suspend the platform 72 from the structure 100. More specifically, the fastener 51 permits a transfer of the load on the platform 72 to the structure 100. The fastener 51 may take many forms. In its most elemental form, the fastener 51 is any hardware connecting the support frame 104 to the structure 100. For example, any bracket, threaded fastener, mating fastener, brad, anchor, or other attachment device could be used. Moreover, it is possible that the fastener 51 may be part of the support post 61, as discussed in greater detail below, or may have more than one piece, such as a toggle bolt, concrete anchor, wall anchor, or the like that cooperates with the fastener 51 to suspend the suspended storage shelf 1.

Figure 3:
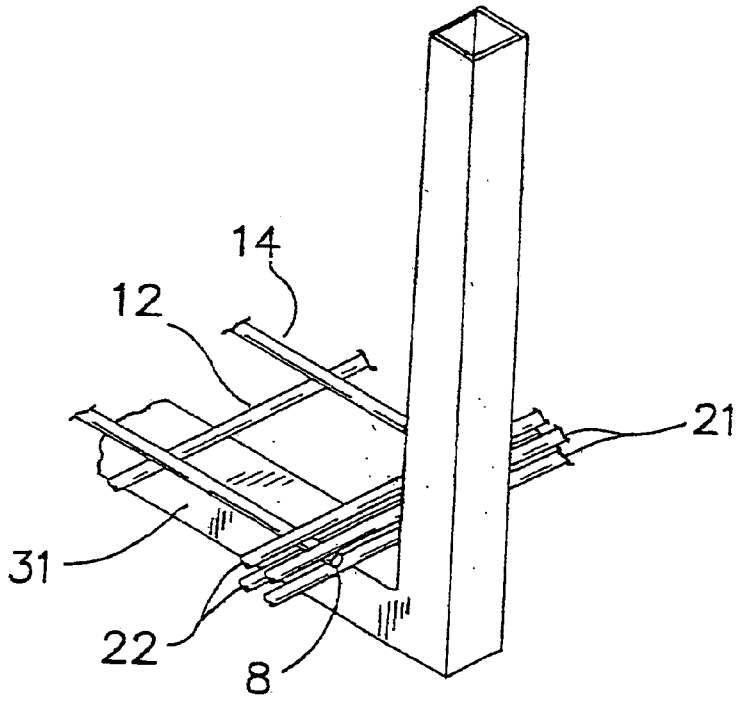
FIG. 3 shows a perspective assembly view of an alternate embodiment of a suspended storage shelf according to the present invention.
Figure 13:
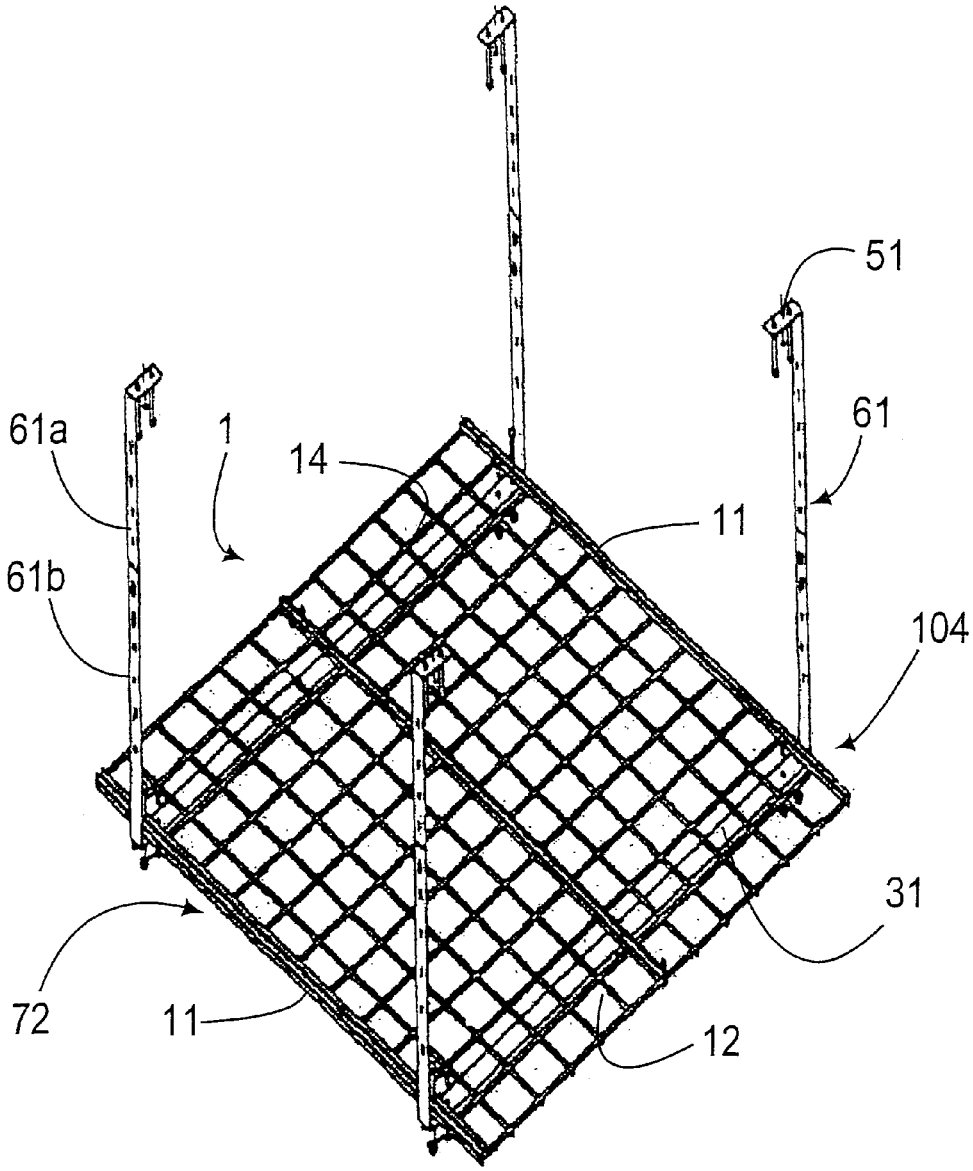
FIG. 13 shows an elevated perspective view of an alternate embodiment of a suspended storage shelf according to the present invention.

In the optional embodiment of FIG. 1 and 3, for example, an angle bracket with two legs 53, 54 may be secured to an upper end of a support post 61. In such an optional embodiment, a first leg 53 with one or more holes 55 therethrough may be secured to the structure 100 using an attachment 57 such as a screw or bolt. A second leg 54 with one or more holes 56 therethrough may be secured to a support post 61 through a hole 65*a* in the support post 61. Alternatively, in the optional embodiment of FIG. 6, the fastener 51 is a flange 110 disposed at an end of a support post 61. For example, in the optional embodiment of FIG. 10, the flange 110 is connected to a receiver 112 that mates to an end of a support post 61. It is noted that in any of these optional embodiments, the fastener 51 may be removable from, fixed to, or integral with the support post 61. For example, in FIG. 13, the fastener 51 is an angle formed at the end of a support post 61. That is, the fastener 51 of the optional embodiment shown in FIG. 13 is not a separate piece but integrally formed with the support post 61.

While certain embodiments of the present invention have been shown and described it is to be understood that the present invention is subject to many modifications and changes without departing from the spirit and scope of the claims presented herein.

We claim:

1. A storage shelf for suspending from a structure, comprising:

a platform comprising two or more individual panels, each panel formed from a plurality of elongate members;

a support frame comprising:

at least one support beam supporting said platform, said panels positioned along said support beam adjacent one another to cooperate to form a substantially continuous surface; and at least two suspension posts spaced from one another and attached at a lower end to said support beam; and a fastener securing said support frame to said structure such that said suspension post and said support beam cooperate to suspend said platform from said structure.

2. The storage shelf of claim 1 wherein said support beam is integrally formed with a lower end of each said suspension post.

3. The storage shelf of claim 1 wherein said support beam has two ends, such that each said support beam end extends beyond said platform.

4. The storage shelf of claim 3 wherein said support frame comprises a suspension post attached at a lower end to each support beam end.

5. The storage shelf of claim 4 wherein the length of said support beam is such that said suspension posts at each support beam end retain said panels in adjacency.

6. The storage shelf of claim 1 further comprising a coupling securing adjacent panels.

7. The storage shelf of claim 6 wherein said panels are formed from a grid of wire members and said coupling comprises a clamp securing adjacent wire members of adjacent panels.

8. The storage shelf of claim 1 wherein each panel is secured to said support beam.

9. The storage shelf of claim 1 wherein said suspension post is of adjustable length.

10. The storage shelf of claim 9 wherein said suspension post has at least two post elements such that the length of said suspension post is adjusted by selectively joining said post elements.

11. The storage shelf of claim 1 wherein said panels are positioned along said support beam such that the edges of adjacent panels are perpendicular to said support beam.

12. The storage shelf of claim 1 wherein said panels are of equal length and said support beam has a length that is an integer multiple of the length of said panels.

13. A storage shelf for suspending from a structure, comprising:

a platform comprising two or more individual panels, each panel formed from a plurality of elongate members, the edges of adjacent panels secured to one another such that adjacent panels cooperate to form a substantially continuous surface;

a support frame comprising:

at least one support beam supporting said platform; and at least two suspension posts spaced from one another and attached at a lower end to said support beam; and a fastener securing said support frame to said structure such that said suspension post and said support beam cooperate to suspend said platform from said structure.

14. The storage shelf of claim 13 wherein said support beam is integrally formed with a lower end of each said suspension post.

15. The storage shelf of claim 13 wherein said support beam has two ends, such that each said support beam end extends beyond said platform.

16. The storage shelf of claim 15 wherein said support frame comprises a suspension post attached at a lower end to each support beam end.

17. The storage shelf of claim 13 further comprising a coupling securing adjacent panels.

18. The storage shelf of claim 17 wherein said panels are formed from a grid of wire members and said coupling comprises a clamp securing adjacent wire members of adjacent panels.

19. The storage shelf of claim 13 wherein each panel is secured to said support beam.

20. The storage shelf of claim 13 wherein said suspension post is of adjustable length.

21. The storage shelf of claim 20 wherein said suspension post has at least two post elements such that the length of said suspension post is adjusted by selectively joining said post elements.

22. A storage shelf for suspending from a structure, comprising:

a platform comprising two or more individual panels, each panel formed from a plurality of elongate members;

a support frame comprising:

at least one support beam supporting said platform, said panels secured to said support beam adjacent one another to cooperate to form a substantially continuous surface; and at least two suspension posts spaced from one another and attached at a lower end to said support beam; and a fastener securing said support frame to said structure such that said suspension post and said support beam cooperate to suspend said platform from said structure.

23. The storage shelf of claim 22 wherein said support beam is integrally formed with a lower end of each said suspension post.

24. The storage shelf of claim 22 wherein said support beam has two ends, such that each said support beam end extends beyond said platform.

25. The storage shelf of claim 24 wherein said support frame comprises a suspension post attached at a lower end to each support beam end.

26. The storage shelf of claim 22 further comprising a coupling securing adjacent panels.

27. The storage shelf of claim 26 wherein said panels are formed from a grid of wire members and said coupling comprises a clamp securing adjacent wire members of adjacent panels.

28. The storage shelf of claim 22 wherein said suspension post is of adjustable length.

29. The storage shelf of claim 22 wherein said suspension post has at least two post elements such that the length of said suspension post is adjusted by selectively joining said post elements.

30. A storage shelf for suspending from a structure, comprising:

a platform comprising two or more individual panels, each said panel formed from a grid of wire members;

a support frame comprising:

at least one support beam supporting said platform, the panels of said platform positioned along said support beam to form a substantially continuous surface; and at least two suspension posts spaced from one another and attached at a lower end to said support beam;

a fastener securing said support frame to said structure such that said suspension post and said support beam cooperate to suspend said platform from said structure; and a coupling securing adjacent panels in the form of a clamp securing adjacent wire members of adjacent panels.

31. A storage shelf for suspending from a structure, comprising:

a platform comprising two or more individual panels, each said panel formed from a grid of wire members, wire members of adjacent panels secured so that adjacent panels cooperate to form a substantially continuous surface;

a support frame comprising:

at least one support beam supporting said platform; and at least two suspension posts spaced from one another and attached at a lower end to said support beam;

a fastener securing said support frame to said structure such that said suspension post and said support beam cooperate to suspend said platform from said structure.

32. A storage shelf for suspending from a structure, comprising:

a platform comprising two or more individual panels, each said panel formed from a grid of wire members;

a support frame comprising:

at least one support beam supporting said platform, said panels secured to said support beam adjacent one another to cooperate to form a substantially continuous surface; and at least two suspension posts spaced from one another and attached at a lower end to said support beam;

a fastener securing said support frame to said structure such that said suspension post and said support beam cooperate to suspend said platform from said structure; and a coupling securing adjacent panels in the form of a clamp securing adjacent wire members of adjacent panels.

33. A storage shelf for suspending from a structure, comprising:

a platform comprising two or more individual panels, each said panel formed from a grid of intersecting elongate wire members;

a support frame comprising:

at least one support beam supporting said platform, said platform attached to said support beam to form a substantially continuous surface; and at least two suspension posts spaced from one another and attached at a lower end to said support beam; and a fastener securing said support frame to said structure such that said suspension post and said support beam cooperate to suspend said platform from said structure.

34. A storage shelf for suspending from a structure, comprising:

a platform comprising two or more individual panels, each said panel formed from a grid of intersecting elongate wire members;

a support frame comprising:

at least one support beam supporting said platform, said panels secured to said support beam adjacent one another to cooperate to form a substantially continuous surface; and at least two suspension posts spaced from one another and attached at a lower end to said support beam; and a fastener securing said support frame to said structure such that said suspension post and said support beam cooperate to suspend said platform from said structure.

35. A storage shelf for suspending from a structure, comprising:

a platform comprising two or more individual panels, each said panel formed from a grid of intersecting elongate wire members;

a support frame comprising:

at least one support beam having two ends, said support beam supporting said platform, said panels secured adjacent one another to cooperate to form a substantially continuous surface; and at least two suspension posts spaced from one another and attached at a lower end to an end of said support beam; and a fastener securing said support frame to said structure such that said suspension post and said support beam cooperate to suspend said platform from said structure.

36. The storage shelf of claim 35 wherein said lower end of each said suspension post is integrally formed with an end of said support beam to form a corner joint.

37. The storage shelf of claim 35 wherein said lower end of each said suspension post comprises an L-shaped flange, said flange attached to an end of said support beam.

* * * * *